US007210761B2

(12) United States Patent
Mott et al.

(10) Patent No.: US 7,210,761 B2
(45) Date of Patent: May 1, 2007

(54) WIPER APPARATUS AND METHOD FOR CLEANING A PRINTHEAD

(75) Inventors: James A. Mott, San Diego, CA (US); John A. Barinaga, Portland, OR (US); Blair A. Butler, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 610 days.

(21) Appl. No.: 10/668,760

(22) Filed: Sep. 23, 2003

(65) Prior Publication Data

US 2005/0062796 A1 Mar. 24, 2005

(51) Int. Cl.
*B41J 2/165* (2006.01)

(52) U.S. Cl. ..... 347/33; 347/29; 347/32

(58) Field of Classification Search ..... 347/22, 347/24, 29, 30, 32, 33
See application file for complete search history.

(56) References Cited

U.S. PATENT DOCUMENTS 5,614,930 A 3/1997 Osborne et al.
5,898,445 A 4/1999 Becker et al.
6,460,968 B1 10/2002 Chee et al.
6,464,327 B1 10/2002 Eckard et al.
6,471,340 B2 10/2002 Meyer
6,527,362 B2 3/2003 Hood et al.
6,533,388 B2 3/2003 Toh et al.
6,540,325 B2 4/2003 Kawamura et al.

FOREIGN PATENT DOCUMENTS

JP 3-215043 * 9/1991
JP 6-71904 * 3/1994

* cited by examiner

*Primary Examiner*—Shih-Wen Hsieh

(57) ABSTRACT

Various embodiments of a wiper apparatus and method for cleaning a printhead are provided. In one embodiment, the wiper apparatus includes a wiper having a leading contact surface, a trailing contact surface, and a capillary passageway that extends at least partially along an axis that intersects the leading contact surface and the trailing contact surface.

22 Claims, 7 Drawing Sheets

WIPER APPARATUS AND METHOD FOR CLEANING A PRINTHEAD

BACKGROUND

Printing devices, such as and inkjet printer, typically contain at least one wiper apparatus for cleaning one or more printheads of ink cartridges. The printhead fires ink through a plurality of nozzles in the nozzle plate of the printhead and a wiper of the wiper apparatus wipes the plurality of nozzles between print jobs to prevent the nozzles from clogging.

In some printer devices each printhead has a separate nozzle plate and each nozzle plate has a separate wiper apparatus for wiping the nozzle plate to prevent cross-contamination of inks and to reduce the incidence of clogging. The use of separate nozzle plates and wiper apparatuses to prevent ink clogging can be very costly. In other printer devices two adjacent wipers of one or more wiper apparatus, are used to clean adjacent nozzles of a single nozzle plate. In some applications cross-contamination of inks along adjacent wipers causes increased clogging of the nozzles which is undesirable.

BRIEF DESCRIPTION OF THE SEVERAL VIEWS OF THE DRAWINGS

The example embodiments of the present invention can be understood with reference to the following drawings. The components in the drawings are not necessarily to scale. Also, in the drawings, like reference numerals designate corresponding parts throughout the several views.

DETAILED DESCRIPTION

Figure 1:
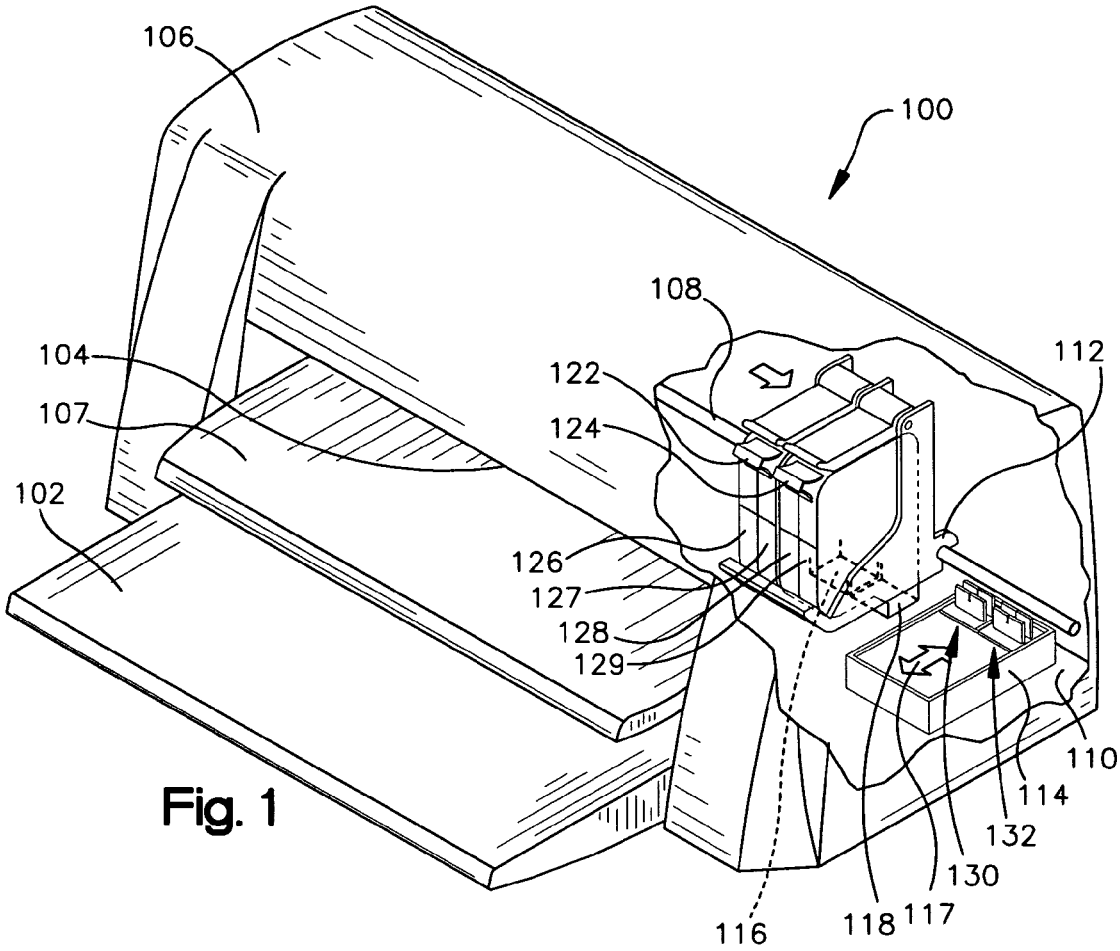
FIG. 1 is a perspective view of an inkjet printer showing one form of a service station according to an embodiment of the invention.

FIG. 1 illustrates an example embodiment of the present invention in the environment of a printer device, for example, inkjet printer 100. A variety of ink-jet printers are commercially available and can include, for example, portable printing units, copiers, facsimile machines, plotters video printers, and cameras, to name a few. While the concepts of the present invention are illustrated with respect to inkjet printer 100 for convenience, the concepts can also apply to the various ink-jet printer types.

In operating the ink jet printer 100, sheets of print media are fed into the ink jet printer 100 through feed tray 102. The print media is moved through the print zone 104, typically by motor-driven rollers (not shown) inside the enclosure 106. After an image is printed on the print media, the print media exits the enclosure 106 onto output tray 107 or its equivalent.

Inside the enclosure 106, a guide rod 108 is mounted to chassis 110 to support a reciprocating carriage 112 which travels in two directions along a single axis, along the print zone 104. A printer motor driven by a controller (not shown) propels the reciprocating carriage 112 along the guide rod 108. The reciprocating carriage 112 is also propelled along guide rod 108 into a servicing station 114 where the printheads 116 and 118 of ink cartridges 122 and 124, commonly known as pens, are each wiped by a wiper apparatus 130 and 132, respectively. The printheads 116, 118 of ink cartridge 122, 124 travel back and forth along the guide rod 108 shooting drops of ink onto the print media as it moves. To clean and protect the printhead, typically a service station can perform a variety of functions including capping and purging or priming to prevent or clear up clogging.

Ink cartridges 122 and 124 can each contain two or more inks, each having a distinct ink composition, for example, ink compositions of different color. For example, the ink can include, but is not limited to, dye-based inks, pigment based inks, thermoplastic inks, composite inks having dye and pigment characteristics, and combinations thereof. Ink cartridge 122 contains a first ink 126 and a second ink 127, and ink cartridge 124 contains a third ink 128 and a fourth ink 129. For example, printhead 116 can dispense a black pigment-based ink and a cyan pigment-based ink which are contained in ink cartridge 122, and printhead 118 can dispense a magenta pigment based ink and a yellow pigment based ink that are contained in ink cartridge 124. Many combinations of ink compositions and color are possible within a single printhead, such as printheads 116, 118.

Figure 2A:
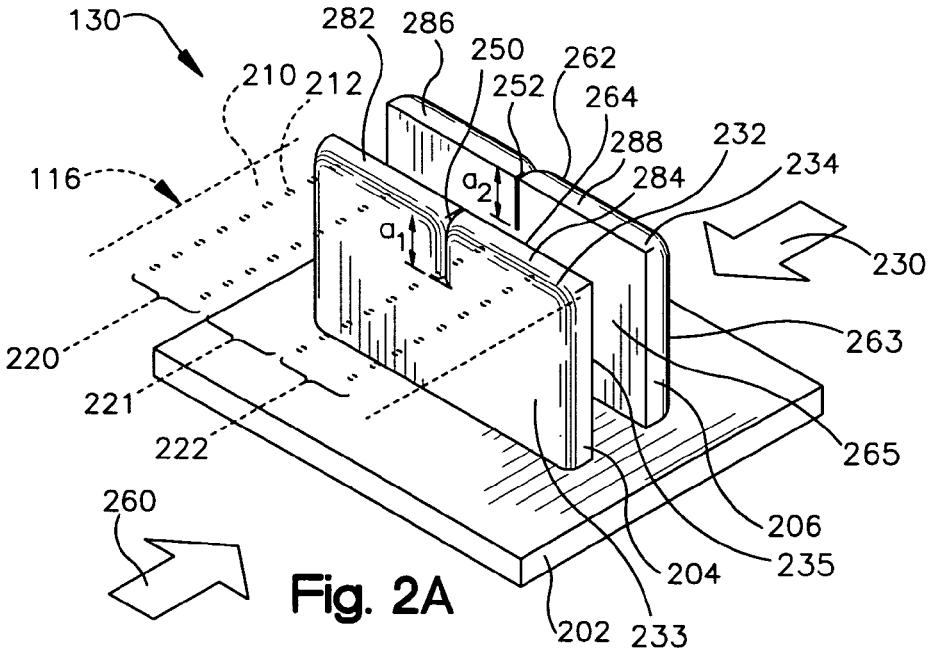
FIG. 2A is a perspective view of the wiper apparatus shown in the service station of FIG. 1 according to an embodiment of the invention.

FIG. 2A is a perspective view of wiper apparatus 130 of FIG. 1 that cleans printhead 116 between print jobs to remove ink residue and other debris. Wiper apparatus 130 includes wiper base 202 and a first wiper 204 and a second wiper 206 which extend from wiper base 202. In accordance with an embodiment of the present invention, first wiper 204 and second wiper 206 each have a capillary passageway 250 and 252, respectively, which draw inks 126, 127 (FIG. 1) away from the printhead 116 (in phantom) during wiping, the details of which will be further described below. Although several aspects of the present invention are described with respect to the wiper apparatus 130 of FIG. 2A, wiper apparatus 130 can include a single wiper, for example first wiper 204 or second wiper 206, rather than both wipers 204, 206, in alternative embodiments.

The first wiper 204 and second wiper 206 can be positioned substantially orthogonal to the nozzle plate 210 of printhead 116 (in phantom) above the wiper apparatus 130. Nozzle plate 210 has a plurality of very small nozzles 212 (in phantom) through which the first ink 126 and the second ink 127 residing in printhead 116 are fired. The arrangement of nozzles 212 in FIG. 2A includes a first nozzle array 220 that is a two-column linear array, and a second nozzle array 222 that is a two-column linear array. Many alternative nozzle arrangements, including but not limited to, three-column or more linear arrays and random, rather than linear, nozzle arrays, for example, are also possible. The first nozzle array 220 fires drops of the first ink 126 (FIG. 1) and the second nozzle array 222 fires drops of the second ink 127 (FIG. 1), both of which are contained in ink cartridge 122. The first ink 126 and the second ink 127 may be different compositions as described above. The number of nozzles 212 per unit area of the nozzle plate 210 dedicated to each ink is the nozzle density, and can contribute to the resolution of images printed. Clogs in the printhead 116 can be cleared by periodically firing ink through the plurality of nozzles 212 in a process known as spitting. Wiper apparatus 130 cleans the nozzle plate 210 of printhead 116 to remove ink residue and other debris that collects on the nozzle plate 210.

Still referring to FIG. 2A, both the first wiper 204 and the second wiper 206 have leading contact surfaces, 232, 262, that face outwards along the leading sides 233 and 263, respectively, and trailing contact surfaces 234, 264, that face inward and opposite each other along trailing sides 235 and 265, respectively. The leading contact surfaces 232, 262, and the trailing contact surfaces 234, 264, are the exterior, outer layer portions of the wipers that contact the printhead 116, and can be at least one of many contour shapes, for example, rounded, angled, sharp-edged, etc. As the wiper apparatus 130 moves during wiping in the direction of wipe indicated by arrow 230, and away from the home position of service station 114 (FIG. 1) the plurality of nozzles 212 of nozzle plate 210 are initially wiped by leading contact surface 232 of first wiper 204 and subsequently wiped by trailing contact surface 234 of second wiper 206. In alternative embodiments, wiper apparatus 130 is bidirectional and can also wipe in direction 260, opposite direction 230. As the wiper apparatus 130 moves in direction 260, the plurality of nozzles 212 are first contacted by the leading contact surface 262 of second wiper 206 and subsequently wiped by the trailing contact surface 264 of first wiper 204. To return to the home position in service station 114, the wiper apparatus 130 moves across the printhead 116 parallel to the two-column linear arrays 220, 222 in direction 260 to complete a second wipe of the nozzle plate 210. In embodiments having a single wiper, for example, a first wiper 204 or a second wiper 206, the wiper apparatus 130 moves in two directions to complete one wipe of the nozzle plate 210. For example, as the wiper apparatus 130 having a wiper 204 moves in direction 230 away from the home position of service station 114 (FIG. 1), the plurality of nozzles 212 are initially wiped by leading contact surface 232. The wiper apparatus 130 then moves in direction 260 and the nozzles 212 are contacted by the trailing contact surface 264 as the wiper apparatus 130 returns to the home position.

As mentioned above, when the first and second wipers 204, 206 pass across the printhead 116, the capillary passageways 250, 252 draw ink away from the nozzle plate 210 by capillary forces to prevent or substantially prevent ink mixing on the wiper surfaces which are in contact with the plurality of nozzles 212 of the nozzle plate 210. The capillary passageways 250, 252 define a first tip 282 and a second tip 284 of first wiper 204, and a third tip 286 and a fourth tip 288 of second wiper 206, respectively. The width of each capillary passageway 250 and 252, i.e. the distance of separation between the first tip 282 and the second tip 284, and the distance between the third tip 286 and the fourth tip 288, respectively, can be any width that enables capillary flow of a liquid, for example, the inks 126, 127, into the capillary passageways 250, 252. The size of the capillary passageways 250, 252 which allow capillary flow can depend upon the surface tension of the particular inks used, the type of material that is used to make the wipers 204, 206, as well as other factors known by those of ordinary skill in the art. In some embodiments, the width of the capillary passageways 250, 252 can be about 0.5 millimeters or less.

The length of each of the capillary passageways 250, 252 can also vary and the length of each capillary passageway 250, 252 is greater than their respective widths. In FIG. 2A capillary passageway 250 extends from the leading side 233 to the trailing side 263 of first wiper 204, and capillary passageway 252 extends from the leading side 235 to the trailing side 265 of second wiper 206. In alternative embodiments, the length of each capillary passageway 250, 252 can be one of several distances between the leading side 233 and the trailing side 263 of first wiper 204, and the leading side 235 and the trailing side 265 of second wiper 206, respectively. Therefore, the length of the capillary passageway can be greater than the width, and in some embodiments the length is at least about four times greater than the width.

The capillary passageways 250, 252 of FIG. 2A intersect leading contact surfaces 232, 262 and trailing contact surfaces 264, 234, respectively, although it is not necessary that the capillary passageways intersect these surfaces. For example, it is possible that inks 126, 127 which accumulate along the wipers 204, 206 can wick along a capillary passageway that intersects at least one of the leading contact surfaces 232, 262 and the trailing contact surfaces 264, 234, and alternatively, into capillary passageways that do not intersect either of the leading contact surfaces 232, 262 and trailing contact surfaces 264, 234. The inks 126, 127 come into contact with one another as they are drawn away from the nozzle plate 212 and along capillary passageways 250, 252 of wipers 204 and 206, respectively.

Each of the capillary passageways 250, 252 of FIG. 2A are substantially straight passageways oriented along an axis that intersects the leading contact surfaces 232, 262 and the trailing contact surfaces 264, 234 of first and second wipers 204, 206, respectively. The length of capillary passageways 250, 252 extends along an axis that is parallel or substantially parallel to the directions of wipe 230, 260; however, in alternative embodiments of the present invention, the capillary passageways 250, 252 can be oriented along one of many axes that intersect the leading contact surfaces 232, 262 and trailing contact surfaces 264, 234. In addition, capillary passageways 250, 252 can extend along the same or different axes. In alternative embodiments, the longitudinal contour of the capillary passageways 250, 252 can be non-linear. For example, the capillary passageways 250, 252 may have one or more curvatures along their respective lengths.

The depth of each capillary passageway 250, 252 can vary, and the depth can extend from the top of first and second wipers 204, 206 to one of many vertical distances up to the overall vertical height of each of the first and second wipers 204, 206 as will be described in further detail below. The width of the capillary passageways 250, 252 can be constant along the depth of the capillary passageways.

Still referring to FIG. 2A, the first wiper 204 and the second wiper 206 are positioned such that during wiping, the first tip 282 and third tip 286 come into contact with the first nozzle array 220 and the second tip 284 and the fourth tip 288 come into contact with the second nozzle array 222. The capillary passageways 250, 252 pass along a separation zone 221 between the first nozzle array 220 and the second nozzle array 222. In this arrangement, the capillary passageways 250, 252 pass between the first and second nozzle arrays, 220, 222, and the wiping action draws the first ink 126 from the first nozzle array 220 and the second ink 127 from the second nozzle array 222 toward each other. The first ink 126 and the second ink 127 are wicked into the capillary passageways 250, 252 by capillary forces which cause the first and second inks 126, 127 to adhere to the surface of the wipers 204, 206 and the surfaces which define the capillary passageways 250, 252. In the same manner described above with respect to wiping apparatus 130, the wiper apparatus 132 (FIG. 1) includes capillary passageways which allow third ink 128 and fourth in 129 to be drawn away from the printhead 118 (FIG. 1) and toward the wiper apparatus 132.

As mentioned above, the depth dimensions of the capillary passageways 250, 252 can vary and may extend from the top of the first and second wipers 204, 206, to the wiper base 202, respectively. In FIG. 2A the capillary passageway 250 extends from the top of the first wiper 204 to a depth indicated by distance $a_1$, and capillary passageway 252 extends from the top of the second wiper 206 to a depth indicated by distance $a_2$. Distances $a_1$ and $a_2$ can be different or equal. The first tip 282 and the second tip 284 are integrated portions of a single blade, that is, the first wiper 204; and the third tip 286 and the fourth tip 288 are integrated portions of a single blade, that is, the second wiper 206. In alternative embodiments (not shown), the first tip 282 and the second tip 284 can be completely separated by the capillary passageway 250 so that the first tip 282 is a portion of a first blade and the second tip is a portion of a second blade of the first wiper 204, and the third tip is a portion of a third blade and the fourth tip is a portion of a fourth blade of second wiper 206.

Inks 126 and 127, if chemically reactive, can readily solidify when drawn into capillary passageways 250, 252, however, the solidification can facilitate easier cleaning of the first and second wipers 204, 206. For example, capillary passageways 250, 252 which extend a distance $a_1$ and $a_2$, respectively, may become completely filled with mixed inks which may be reacted inks and may be dried inks. However, the first wiper 204 and the second wiper 206 can be cleaned, for example, by a scraper (not shown) that deflects the first and second wipers 204, 206 through dimensional interference between the wiper apparatus 130 and the scraper. Thus, for example, the first wiper 204 can be cleaned by a scraper that deflects the first tip 282 and the second tip 284 upon contact through dimensional interference, and thereby easily dislodging mixed inks collected in capillary passageway 250. Once cleared, capillary passageway 250 is ready to collect additional inks 126, 127 in a subsequent wiping stroke. The volume of ink 126, 127, that can be drawn by capillary passageways 250 and 252 can be determined, in part, by the depth of the capillary passageways, the extent to which the capillary passageways 250, 252 can be cleaned, as well as other factors known to one of ordinary skill in the art. For example, capillary passageways 250 and 252 can have additional capillary pathways (not shown) that branch outward from the capillary passageways 250, 252 (FIG. 2A), to form capillary passageways having a tree-like structure. Regardless of the amount of inks 126, 127 that are drawn into the capillary passageways 250, 252 upon initial wiping, the amount of ink 126, 127 that can be drawn into the capillary passageways 250, 252 upon subsequent wiping, may depend upon the amount of ink that can reasonably be removed when the wiper is cleaned via scraping or otherwise.

Figure 2B:
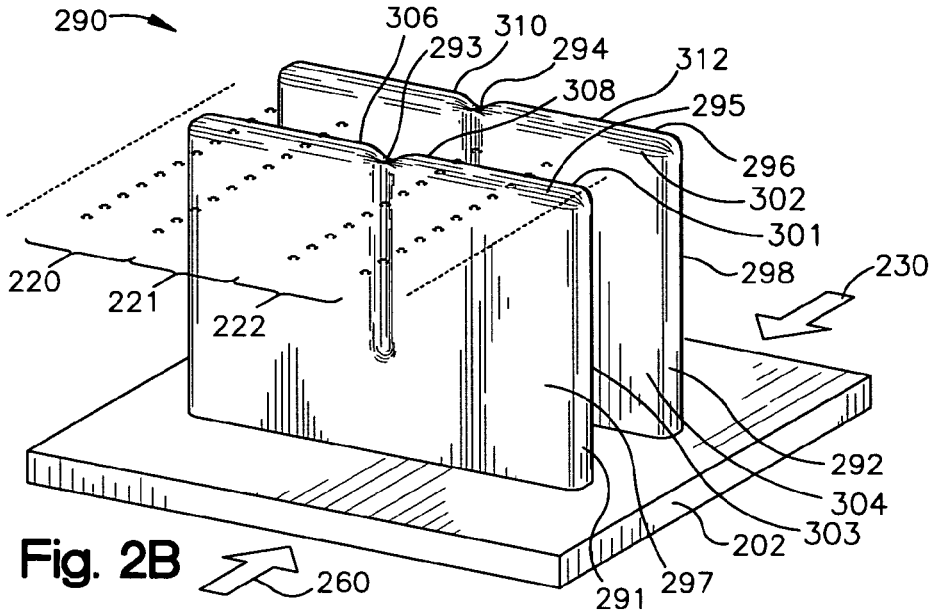
FIG. 2B is a perspective view of a wiper apparatus that can be located in the service station of FIG. 1 according to an embodiment of the invention.

FIG. 2B is a perspective view of a wiper apparatus 290 according to another embodiment of the present invention, which can be used to clean printhead 116 (FIG. 1). Details regarding the operation of the wiper apparatus 290 as it pertains to cleaning a printhead, for example, printhead 116, is consistent with that described above with regard to wiper apparatus 130 of FIG. 2A. Wiper apparatus 290 includes wiper base 202 and a first wiper 291 and a second wiper 292 which extend from the wiper base 202. The first wiper 291 and the second wiper 292 each have at least one capillary passageway, 293, 294, respectively, formed therein to prevent or substantially prevent ink mixing of the two or more inks fired from an ink cartridge, for example ink cartridge 122 (FIG. 1). Both the first wiper 291 and the second wiper 292 have leading contact surfaces, 295, 296, that face outwards along the leading sides 297 and 298, respectively, and trailing contact surfaces 301, 302, that face inward and opposite each other along the trailing sides 303 and 304, respectively.

The leading contact surfaces 295, 296, and the trailing contact surfaces 301, 302, are the exterior, outer layer portions of the wipers that contact the printhead 116, and can be one of many contour shapes, for example, rounded, angled, sharp-edged, etc. Capillary passageway 293 of first wiper 291 extends along an axis that intersects the leading contact surface 295 and the trailing contact surface 301 of the first wiper 291 to define a first tip 306 and a second tip 308 of first wiper 291. Capillary passageway 294 of second wiper 292 also extends along an axis that intersects the leading contact surface 296 and the trailing contact surface 301 of the second wiper 292 to define a third tip 310 and a fourth tip 312 of second wiper 292. The capillary passageways 293, 294 extend into wipers 291, 292 along both the leading sides 297, 298 and the trailing sides 303, 304 in a webbed capillary passageway arrangement. The inks 126, 127 can flow into each of these webbed capillary passageways 293 and 294 to prevent or substantially prevent ink mixing along the wiper surfaces which are in contact with the purality of the nozzles 212.

The capillary passageways 293, 294 of FIG. 2B intersect leading contact surfaces 295, 296 and trailing contact surfaces 301, 302, respectively, however, in some embodiments, capillary passageway 293 can extend along a portion of the axis that intersects the leading contact surface 295 and trailing contact surface 301, and capillary passageway 294 can extend along a portion of the axis that intersects the leading contact surface 296 and the trailing contact surface 302. That is, the capillary passageways 293, 294 may intersect at least one of the leading contact surfaces 295, 296, and the trailing contact surfaces 301, 302, respectively. In alternative embodiments, the capillary passageways 293, 294 may not intersect any of the leading contact surfaces 295, 296 and trailing contact surfaces 301, 302. As described above, with respect to capillary passageways 250, 252 of wiper apparatus 130 in FIG. 2A, the capillary passageways 293, 294 can extend along an axis that is parallel or substantially parallel to the directions of wipe 230, 260, and in some embodiments of the present invention, the capillary passageways 293, 294 can extend along one of many axes that intersect the leading contact surfaces 295, 296 and trailing contact surfaces 301, 302. In addition, capillary passageways 293, 294 can each extend along an axis that is the same or different.

Figure 3:
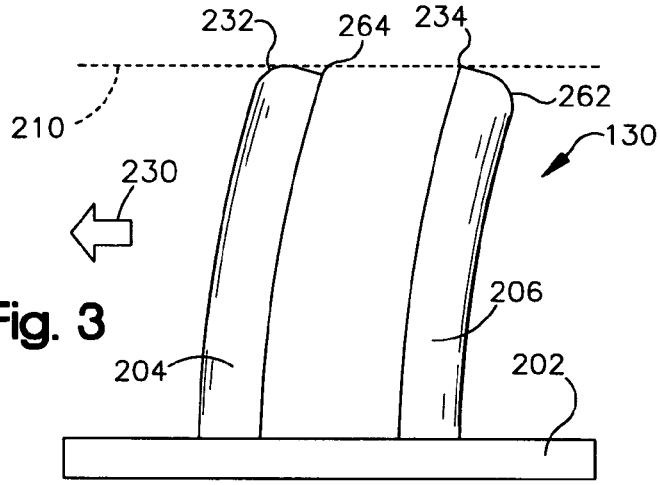
FIG. 3 is a side elevation view of the wiper apparatus of FIG. 2A and FIG. 2B according to an embodiment of the invention.

Referring to FIG. 3 a side elevation view of wiper apparatus 130 reveals the contours of the first and second wipers 204, 206 according to another embodiment of the invention. The vertical positioning of the wiper apparatus 130 under the printhead 116 results in interference between the nozzle plate 210 and the wipers 204 and 206, which causes the wipers 204, 206 to deflect in order to draw and squeegee ink for cleaning. The vertical interference between the nozzle plate 210 and the wipers 204 and 206 can be, for example, at least about 1 millimeter, and in some embodiments the interference is greater than about 2 millimeters.

The leading contact surfaces 232 and 262 are rounded and the trailing contact surfaces 264 and 234 are angular, having a cornered edge, to facilitate improved cleaning of the nozzle plate 210. The rounded leading contact surfaces 232, 262 pull ink out of the plurality of nozzles 212 to wet the nozzle plate 210 and to help prevent scratching of the printhead 116 by the first and second wipers 204, 206. The ink can also act as a solvent to dissolve dried ink residue accumulated on the nozzle plate 210. The angular contour of trailing contact surfaces 264, 234 squeegees the ink, paper fibers, and other debris as pressure is applied on the nozzle plate due to the dimensional interference between the wiper apparatus 130 and the nozzle plate 210.

Figure 4:
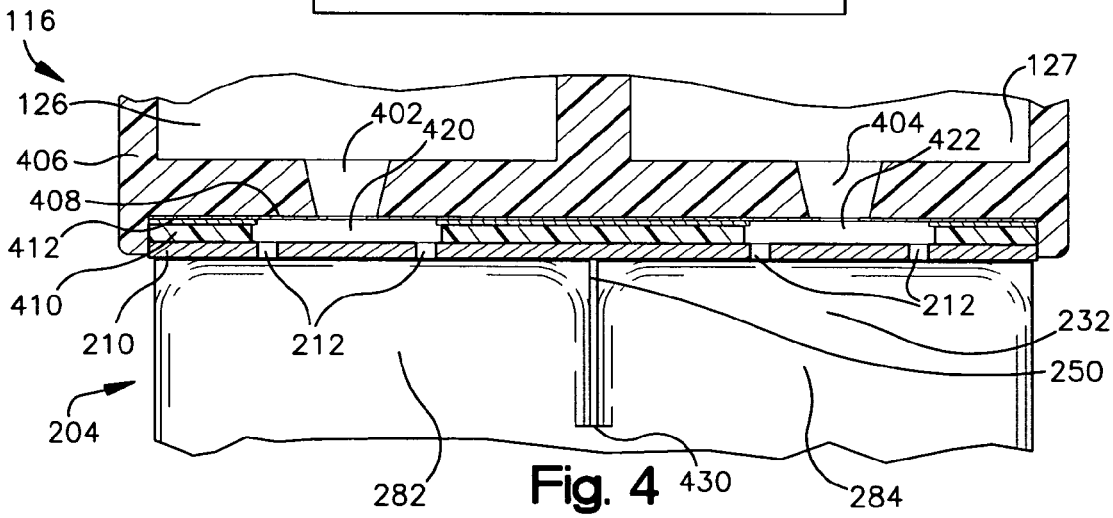
FIG. 4 is a cross-sectional view of a printhead and a front elevation view of the wiper apparatus of FIG. 2A and FIG. 2B with the wiper apparatus in contact with the printhead during wiping according to an embodiment of the invention.

FIG. 4 is a cross-sectional view of printhead 116 and is provided for reference to more detailed features of the printhead. Ink 126 and ink 127 are dispensed through tapered openings 402 and 404 of printhead 116 and through a plurality of nozzles 212 formed through nozzle plate 210 of die 406. Upon exiting the tapered openings 402 and 404, inks 126 and 127 flow into fluidic chambers 420, 422 and circulate around barrier geometry 410 that is heated by underlying heating elements (not shown). Thin film layer 412 contains electrical circuitry logic to control the firing of the ink 126 and 127 through the plurality of nozzles 212.

As described above with respect to FIG. 2A, the wiper 204 passes below the plane in which the plurality of nozzles 212 are formed. The capillary passageway 250 passes between the first nozzle array 220 and the second nozzle array 222 and draws ink 126 away from the nozzle plate 210 while preventing, or substantially preventing, ink 126 from wicking across the first wiper 204 from the first nozzle array 220 to the second tip 284 and to the second nozzle array 222. The capillary passageway 250 also draws ink 127 away from the nozzle plate 210 while preventing, or substantially preventing, ink 127 from wicking across the first wiper 204 from the second nozzle array 222 to the first tip 282 and to the first nozzle array 220. Thus, capillary passageway 252 passes between the first nozzle array 220 and the second nozzle array 222 and draws inks 126 and 127 away from the nozzle plate 210 while preventing, or substantially preventing, cross-contamination of inks 126 and 127. The capillary passageway 250 is shown terminating at a location 430 of wiper 204, however, the capillary passageway can have a depth along any vertical distance of the wiper, as describe above with respect to FIG. 2A.

Figure 5:
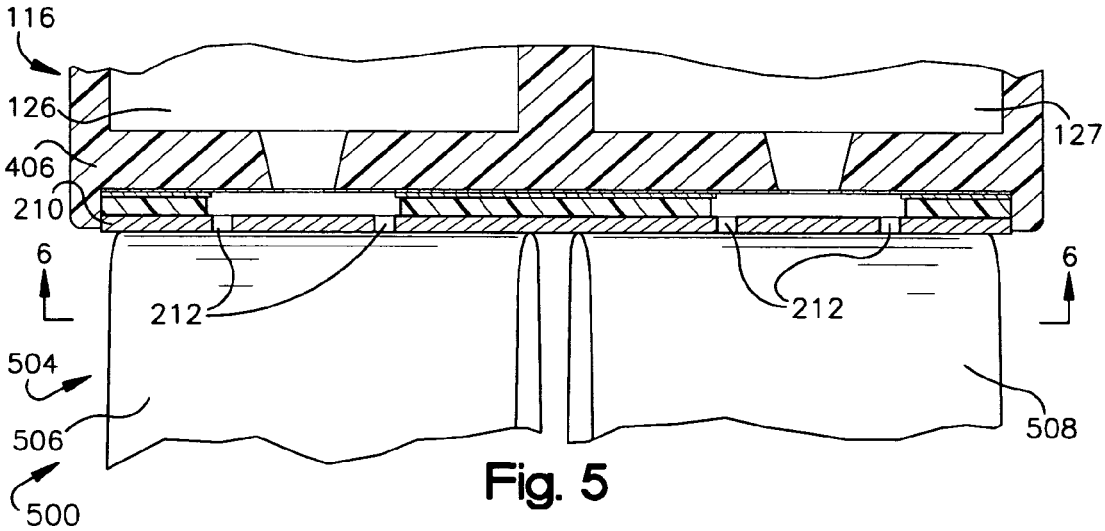
FIG. 5 is a cross-sectional view of a printhead and a front elevation view of the wiper apparatus in contact with the printhead during wiping according to an embodiment of the invention.

Turning to FIG. 5 is a partial cross-sectional view of a printhead 116 as it is contacted by wiper apparatus 500 in accordance with another embodiment of the present invention. First wiper 504 has a first tip 506 and a second tip 508 which are oriented at an angle with respect to each other to separate the flow of the first ink 126 and the second ink 127 from one another during wiping on the same nozzle plate 210. Inks 126, 127 which exit the printhead 116 through a plurality of nozzles 212 in nozzle plate 210 are pushed in outward directions toward the edges of the orifice plate 210.

Figure 6:
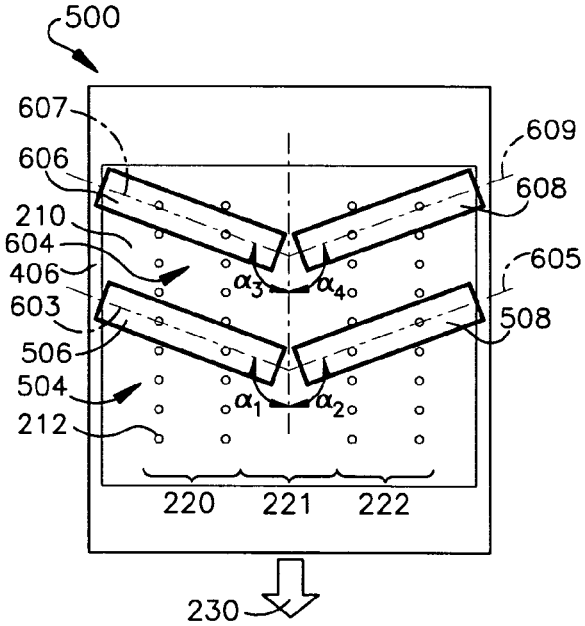
FIG. 6 is a cross-sectional view of the wiper apparatus in contact with the printhead taken along the lines 6—6 of FIG. 5 according to an embodiment of the invention.

A cross-section of wiper apparatus 500 taken along lines 6—6 of FIG. 5 is illustrated in FIG. 6. The first wiper 504 and the second wiper 604 perform a "snowplow" unidirectional wipe along nozzle plate 210 of printhead 116. The first tip 506 and the second tip 508 of first wiper 504 and the third tip 606 and the fourth tip 608 of second wiper 604 are each oriented at an angle with respect to the direction of wipe 230. The first tip 506 lies along axis 603 and oriented along an angle $\alpha_1$ relative to the direction of wipe 230. The second tip 508 lies along the axis 605 and oriented along an angle $\alpha_2$ relative to the direction of wipe 230. The third tip 606 lies along the axis 607 and oriented along an angle $\alpha_3$ relative to the direction of wipe 230. The fourth tip 608 lies along the axis 609 and oriented along an angle $\alpha_4$ relative to the direction of wipe 230. As wiper apparatus 500 moves in the direction of wipe 230, the first tip 506 of first wiper 504 wipes the nozzle plate 210 in a direction that is substantially perpendicular to a first axis 603, the second tip 508 of first wiper 504 wipes the nozzle plate in a direction that is substantially perpendicular to the second axis 605, the third wiper 606 of second wiper 604 wipes the nozzle plate in a direction that is substantially perpendicular to the third axis 607, and the fourth wiper 608 of second wiper 604 wipes the nozzle plate in a direction that is substantially perpendicular to the fourth axis 609. The first axis 603, the second axis 605, the third axis 607 and the fourth axis 609 can each be distinct from one another. The angles $\alpha_1$, $\alpha_2$, $\alpha_3$, $\alpha_4$ can each be greater than about 90 degrees relative to the axis of wipe 230. In some embodiments of the present invention, the angles $\alpha_1$, $\alpha_2$, $\alpha_3$, $\alpha_4$ can be greater than about 90 degrees and less than about 180 degrees, and yet in other embodiments, they can range from about 120 degrees to about 150 degrees. The combined angle between the first tip 506 and the second tip 508 of wiper 504 can be at least about 180 degrees, and the combined angle between the third tip 606 and the fourth tip 608 of second wiper 604 can be at least about 180 degrees. The angles $\alpha_1$, $\alpha_2$, $\alpha_3$, $\alpha_4$ can be substantially equal to one another, or the angles may be different from each other, or some angles may be substantially equal and some may be different than the others.

Figure 7:
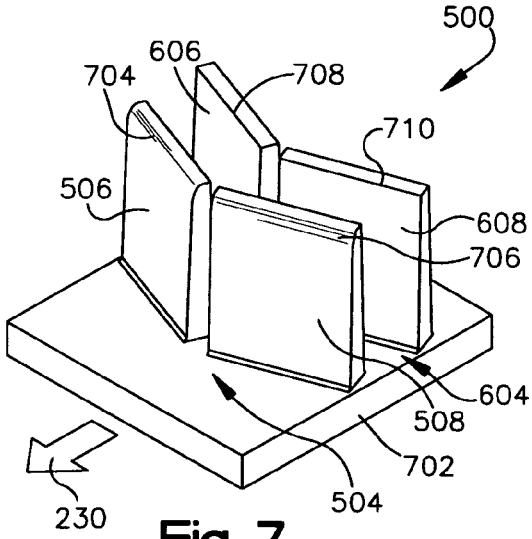
FIG. 7 is a perspective view of the wiper apparatus of FIG. 6 according to an embodiment of the invention.

FIG. 7 is a perspective view of wiper apparatus 500 described above with reference to FIG. 5 and FIG. 6. Leading contact surfaces 704 and 706 of the first tip 506 and the second tip 508, respectively, of the first wiper 504 can be rounded, and the trailing contact surfaces 708 and 710 of the third tip 606 and the fourth tip 608, respectively, of second wiper 604 can be angled. Therefore, when the wiper apparatus 500 makes a unidirectional wipe in the direction 230, the rounded contour of contact surfaces 704, 706 of the first and second tips 506, 508 draws ink out of the plurality of nozzles 212 (FIG. 6) to wet the nozzle plate 210 (FIG. 6). The angular contour of the trailing contact surfaces 708 and 710 of the third tip and fourth tip 606, 608, respectively, squeegee the inks 126, 127, (FIG. 1). Referring to FIG. 7 the first tip 506 and the second tip 508 of the first wiper 504 are integrated portions of two separate and distinct wiper blades mounted on wiper base 702. However, in alternative embodiments, the first tip 506 and the second tip 508 of first wiper 504 can be separated portions of a single wiper blade mounted on the wiper base 702 (not shown). Likewise, the third tip 606 and the fourth tip 608 of the second wiper 604 can be integrated portions of separate and distinct wiper blades, as illustrated in FIG. 7, however, the tips 606, 608 can also be separated portions of a single wiper blade (not shown). The flexibility, movement and wiping performance of wiper apparatus 500 may be enhanced when the first wiper 504 and the second wiper 604 have tips that are at least partially separated, i.e. when the first tip 506 is separated from second tip 508, and third tip 606 is separated from fourth tip 608.

Figure 8:
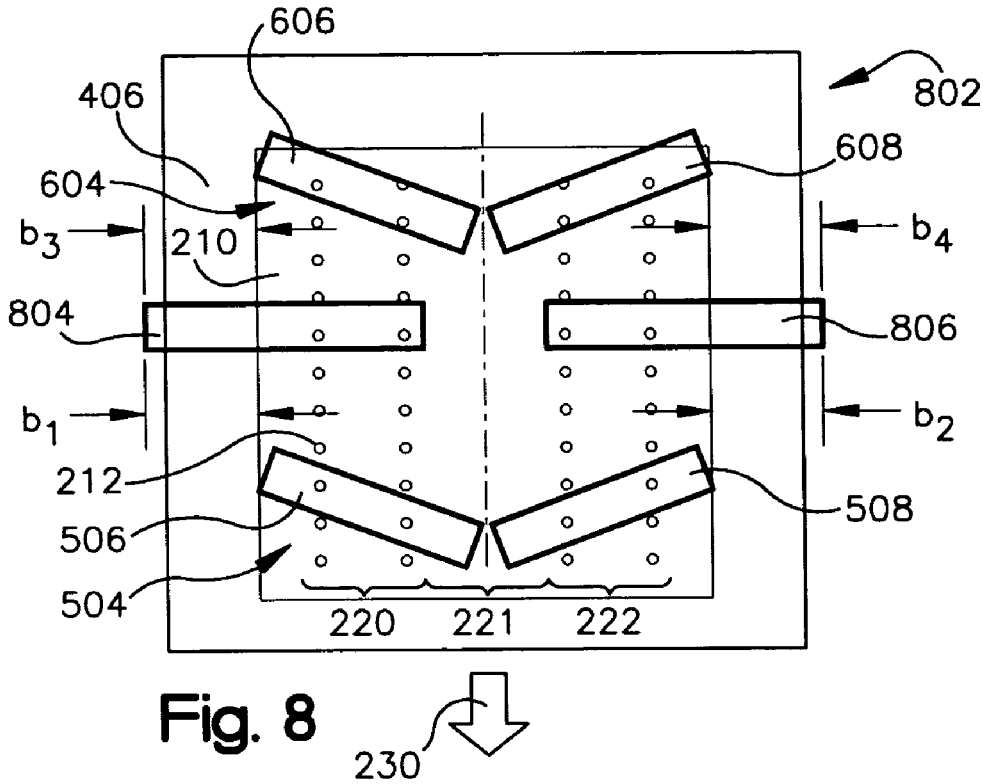
FIG. 8 is a cross-sectional view of the wiper apparatus in contact with the printhead of FIG. 1 according to an embodiment of the invention.

In an alternative embodiment of the invention, the wiper apparatuses described above can also include cheek wipers. Wiper apparatus 802 of FIG. 8 and FIG. 9 include cheek wipers 804 and 806 which function to remove residual ink that collects on nozzle plate 210 and the printhead 116 and which cannot be contacted by the reach of the first wiper 504 and the second wiper 604. In FIG. 8, the cross-sectional view of wiper apparatus 802 in contact with the printhead 116 shows that the left cheek wiper 804 can extend a lateral distance $b_4$ beyond the first tip 506 of first wiper 504 and a lateral distance $b_3$ beyond the third tip 606 of the second wiper 604. Also, the right cheek wiper 806 can extend a lateral distance $b_2$ beyond the second tip 508 of first wiper 504 and a lateral distance $b_4$ beyond the fourth tip 608 of second wiper 604. The distances b1, b2, b3 and b4 can be equal or unequal to one another. For example, first wiper 504 and second wiper 604 are shown in alignment relative to one another, although the positioning of the left cheek wiper 804 relative to the first wiper 504 and second wiper 604, i.e. distance b1 and distance b3, can be different. Also, the placement of the right cheek 806 wiper need not be symmetrical to the placement of the left cheek wiper 804.

In the embodiment shown in FIG. 8 for example, cheek wipers 804 and 806 extend beyond the printhead die 406 to ensure that all residual ink outside the reach of first wiper 504 and the second wiper 604 that is collected on the printhead 116 can be wiped. In some embodiments, the cheek wipers 804, 806 can reach as far as a location between the nozzle plate 210 and the outer edge of printhead die 406, as well as distances closer to the first wiper 504 and second wiper 604. The cheek wipers 804, 806 are sized and positioned such that they can overlap the wiping path of the first and second wipers 504, 604, in addition to extending beyond the cheek wipers. In addition, the cheek wipers 804, 806 can be located between the first and second wipers 504, 604, as shown in FIG. 8, however in alternative embodiments (not shown), cheek wipers 804, 806 can be located behind both the first and second wipers 504, 604.

Figure 9:
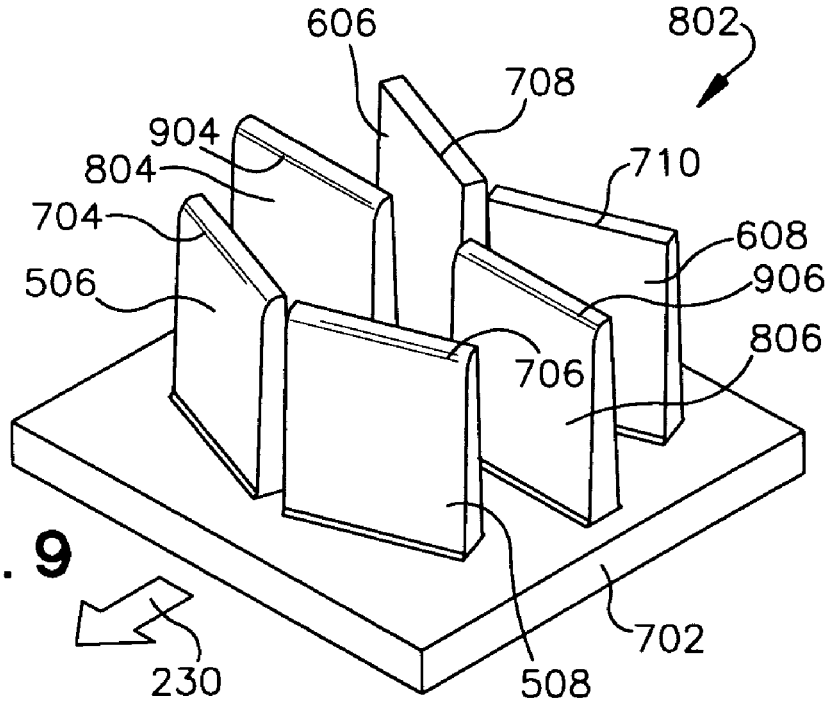
FIG. 9 is a perspective view of the wiper apparatus of FIG. 8 according to an embodiment of the invention.

A perspective schematic of the wiper apparatus 802 of FIG. 8 is illustrated in FIG. 9. In one embodiment, first tip 506 and second tip 508 have leading contact surfaces 704 and 706, respectively, which have a rounded contour to allow the tips 506, 508 to pull ink from nozzles 212 to wet the nozzle plate 210, as described above with respect to wiper apparatus 130 in FIG. 3. Cheek wipers 804 and 806 have leading contact surfaces 904 and 906, respectively, which are rounded surfaces, however, the leading contact surfaces 904 and 906 can also have angular surfaces. Third tip 606 and fourth tip 608 may have a leading contact surface 708 and 710, respectively, which are angular to squeegee the ink and debris that has collected on nozzle plate 210. Although the contour of the wiper tips 506, 508, 606, 608 and cheek wipers 804, 806, can improve wiping performance in particular printer devices the specific contour arrangement is not critical and alternative embodiments are possible.

Figure 10A:
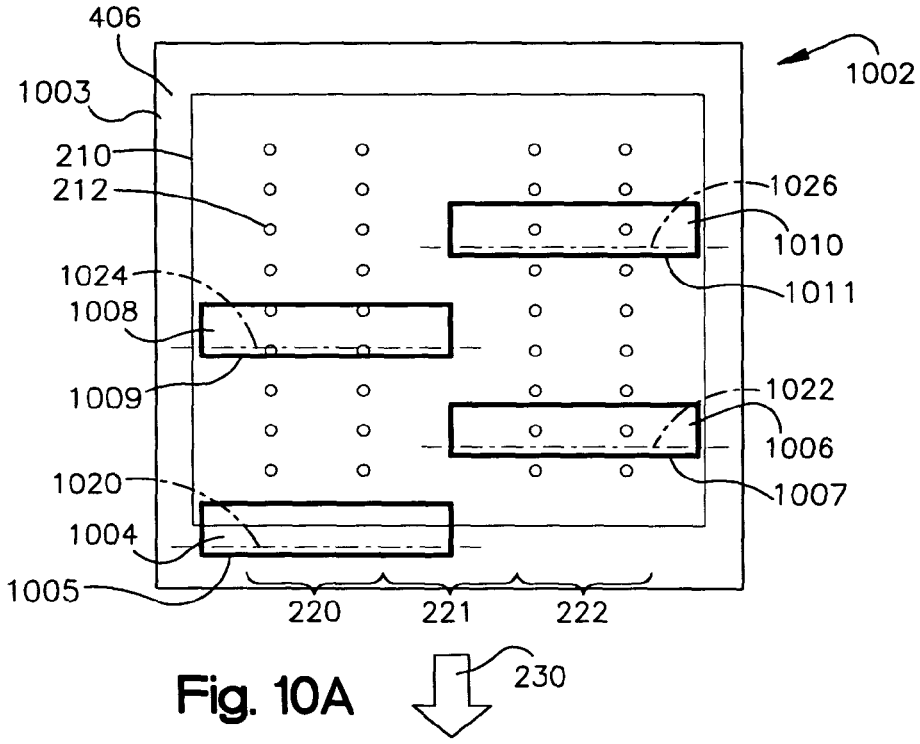
FIG. 10A is a cross-sectional view of a wiper apparatus in contact with the printhead of FIG. 1 according to an embodiment of the invention.

Turning to FIG. 10A is a cross-sectional view of a wiper apparatus 1002 used, for example, in cleaning a printhead 116 of inkjet printer 100 (FIG. 1), in accordance with another embodiment of the present invention. Wiper apparatus 1002 includes a wiper base (not shown), and a first wiper 1004 that leads a second wiper 1006 during wiping in the direction of wipe 230. The leading contact surface 1005 of the first wiper 1004 and the leading contact surface 1007 of the second wiper 1006 are misaligned with respect to one another. The leading contact surface 1005 lies along the first axis 1020 and the leading contact surface 1007 of the second wiper 1006 lies along the second axis 1022, the first axis 1020 being distinct from the second axis 1022. The first wiper 1004 and the second wiper 1006 are substantially parallel to one another, and the first wiper 1004 and the second wiper 1006 are substantially perpendicular to the direction of wipe 230. However, it is not necessary that the first and second wipers 1004, 1006 be substantially parallel to one another or perpendicular to the direction of wipe as will be further described below.

Still referring to FIG. 10A nozzle plate 210 has a first nozzle array 220 to dispense a first ink 126 (FIG. 1) and a second nozzle array 222 to dispense a second ink 127 (FIG. 1), and wiper apparatus 1002 is oriented so that the first wiper 1004 contacts the first nozzle array 220 and the second wiper 1006 contacts the second nozzle array 222 during wiping. The first wiper 1004 does not extend a distance sufficient to contact the second nozzle array 222 during wiping and the second wiper 1006 does not contact the first nozzle array 220 during wiping. The plurality of nozzles 220 that lie along an axis that is perpendicular to the direction of wipe 230, for example, first axis 1020, are consecutively contacted by the first wiper 1004 and the second wiper 1006 during wiping. As the first wiper 1004 wipes the first nozzle array 220 along axis 1020, the adjacent nozzles 212 of the second nozzle array 222 which lie along the same axis 1020 are not contacted by the first wiper 1004, and as the second wiper 1006 wipes the second nozzle array 222 along axis 1022, the adjacent nozzles 212 of the first nozzle array 220 along axis 1020 are not contacted by the second wiper 1006. Thus, the discontinuity and misalignment between the leading contact surface 1005 of the first wiper 1004 and the leading contact surface 1007 of the second wiper 1006 can prevent mixing of the inks 126, 127 as the wipers 1004, 1006 contact the nozzle plate 210. The first and second wipers 1004, 1006 can be spaced apart, and in alternative embodiments (not shown), they can be touching or overlapping.

In an alternative embodiment of the present invention, the first wiper 1004 and the second wiper 1006 can extend from separate wiper bases that move independently in the direction of wipe. For example, the leading contact surface 1005 of the first wiper 1004 and the second contact surface 1007 of the second wiper 1006 can be aligned along the same axis 1020 when the wiper apparatus 1002 is in the home position prior to wipe, and the leading contact surfaces 1005, 1007 can be moved independently to become misaligned during wiping.

In FIG. 10A the first wiper 1004 and the second wiper 1006 are sized so that the separation zone 221 of the nozzle plate 210 is contacted by the first wiper 1004 or the second wiper 1006, or both, although it is not necessary that any portion of the separation zone 221 be contacted by the wipers 1004 and 1006. In alternative embodiments the first wiper 1004 and the second wiper 1006 can be sized to be overlapping, so that at least a portion of the separation zone 221 is contacted by both the first wiper 1004 and the second wiper 1006.

In another embodiment of the present invention, wiper apparatus 1002 includes a third wiper 1008 that follows the second wiper 2006 and a fourth wiper 1010 that follows the third wiper 2008 during wiping in the direction of wipe 230. The third wiper 1008 does not contact the second nozzle array 222 during wiping and the fourth wiper 1010 does not contact the first nozzle array 220 during wiping. The leading contact surface 1009 of the third wiper 1008 which lies along the third axis 1024 and the leading contact surface 1011 of the fourth wiper 1010 which lies along the fourth axis 1026, are misaligned with respect to one another. The first, second, third and fourth wipers 1004, 1006, 1008, 1010 are substantially parallel to one another and are substantially perpendicular to the direction of wipe 230, however, as mentioned above, it is not necessary that the wipers be substantially parallel to one another or perpendicular to the direction of wipe 230.

In some embodiments of the invention, wiper apparatus 1002 can include cheek wipers (not shown) which can follow any of the first, second, third and fourth wipers 1004, 1006, 1008, and 1010 as described above with respect to wiper apparatus 802 of FIG. 8.

The wiper apparatus 1002 of FIG. 10A has four wipers arranged in two columns that wipe along the first nozzle array 220 and the second nozzle array 222, although, in alternative embodiments, wiper apparatus 1002 can have additional wipers arranged to wipe two or more nozzles arrays.

Figure 10B:
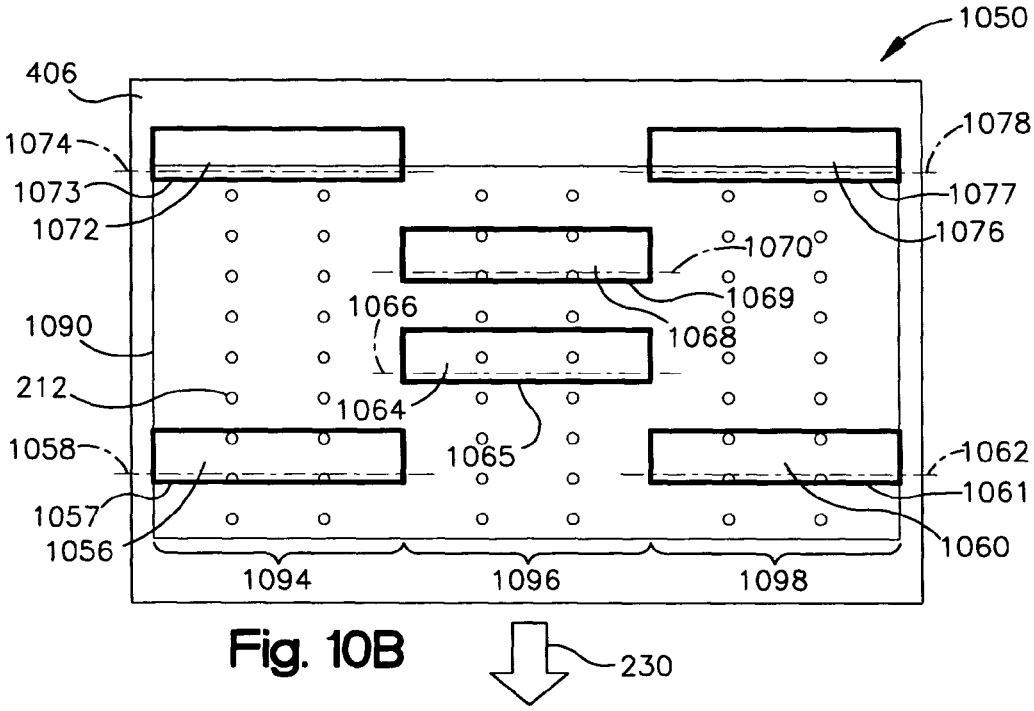
FIG. 10B is a cross-sectional view of a wiper apparatus in contact with the printhead of FIG. 1 according to an embodiment of the invention.

FIG. 10B is a cross-sectional view of wiper apparatus 1050 wiping a nozzle plate 1090 that has three nozzle arrays 1094, 1096, 1098, according to another embodiment of the invention. For example, printhead 116 (FIG. 1) can contain three or more inks which can be distinct from one another. In one embodiment, the wiper apparatus 1050 includes first wiper 1056 that wipes the first nozzle array 1094, a second wiper 1064 that wipes the second nozzle array 1096, and a third wiper 1060 that wipes the third nozzle array 1098, during wiping. First and second wipers, 1056, 1064 which wipe adjacent nozzle arrays, 1094, 1096 are misaligned. Likewise, second and third wipers, 1064, 1060 which wipe adjacent nozzle arrays 1096, 1098 are misaligned. Specifically, the leading contact surface 1057 of the first wiper 1056 that lies along axis 1058 and the leading contact surface 1065 of second wiper 1064 that lies along axis 1066 are misaligned. In this arrangement, the nozzles 212 that lie along axis 1058 of the first nozzle array 1094 and the second nozzle array 1096, are wiped consecutively. Likewise, the nozzles 212 that lie along axis 1062 of the third nozzle array 1098 and along axis 1066 of the second nozzle array 1096, are wiped consecutively. The alignment of the leading contact surface 1057 of the first wiper 1056 along the first axis 1058 can be the same or different than the leading contact surface 1061 of third wiper 1060 along the third axis 1062 during wiping.

In another embodiment of the invention, wiper apparatus 1050 can also include a forth wiper 1068 that wipes the second nozzle array 1096, a fifth wiper 1072 that wipes the first nozzle array 1094, and a sixth wiper 1076 that wipes the third nozzle array 1098. As would be known by one skilled in the art, many alternative embodiments of wiper apparatus are possible. The wiper apparatus can have additional wipers to wipe additional nozzle arrays for dispensing several different inks. As described in the examples above, the leading contact surfaces of the wipers that are directly adjacent to one another are misaligned so that adjacent nozzle arrays are wiped consecutively rather than simultaneously.

Figure 11:
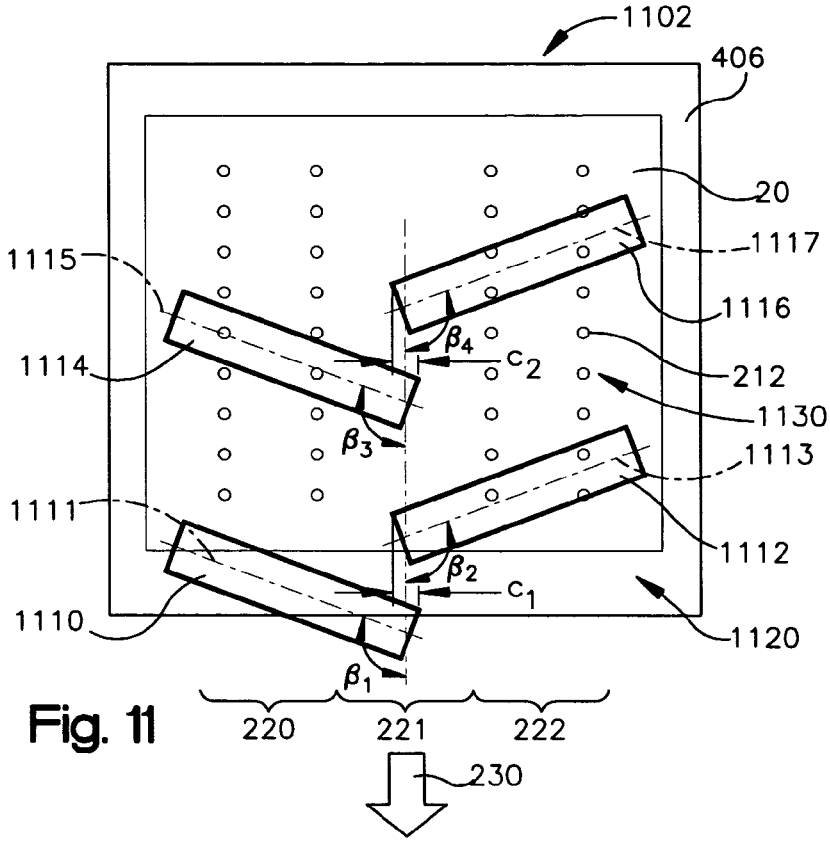
FIG. 11 is a cross-sectional view of a wiper apparatus in contact with the printhead of FIG. 1 according to an embodiment of the invention.

Wiper apparatus 1102 of FIG. 11, in accordance with another embodiment, includes a first wiper 1120 that has a first tip 1110 and a second tip 1112 which are oriented at an angle relative to each other and relative to the direction of wipe 230. The first tip 1110 is oriented along first axis 1111 at an angle $\beta_1$ relative to the direction of wipe 230 and the second tip 1112 is oriented along a second axis 1113 at an angle $\beta_2$ relative to the direction of wipe 230. Angles $\beta_1$ and $\beta_2$ are greater than about 90 degrees to direct ink residue and debris associated with the first and second array of nozzles 220, 222, in divergent directions to reduce the incidence of ink mixing. Angles $\beta_1$, and $\beta_2$ can range from greater than about 90 degrees to about 180 degrees, and in some embodiments, $\beta_1$ and $\beta_2$ can range from about 120 degrees to about 150 degrees.

Wiper apparatus 1102 can also include a second wiper 1130 having a third tip 1114 and a fourth tip 1116 so that the third tip 1114 contacts the first nozzle array 220 and the fourth tip 1116 contacts the second nozzle array 222 and the third tip 1114 follows the second tip 1112 and leads the fourth tip 1116 during wiping in the direction of wipe 230. In FIG. 11, the third tip 1114 and the fourth tip 1116 of second wiper 1130 are oriented at an angle relative to each other and relative to the direction of wipe 230. The third tip 1114 is oriented along third axis 1115 at an angle $\beta_3$ relative to the direction of wipe 230 and the fourth tip 1116 is oriented along a fourth axis 1117 at an angle $\beta_4$ relative to the direction of wipe 230. Angles $\beta_3$ and $\beta_4$ can range from greater than about 90 degrees to about 180 degrees, and in some embodiments, $\beta_3$ and $\beta_4$ can range from about 120 degrees to about 150 degrees. In the various embodiments relating to a wiper apparatus having angled wiper tips that are staggered, ink mixing can be prevented where two distinct inks are fired through the same orifice plate.

Figure 12:
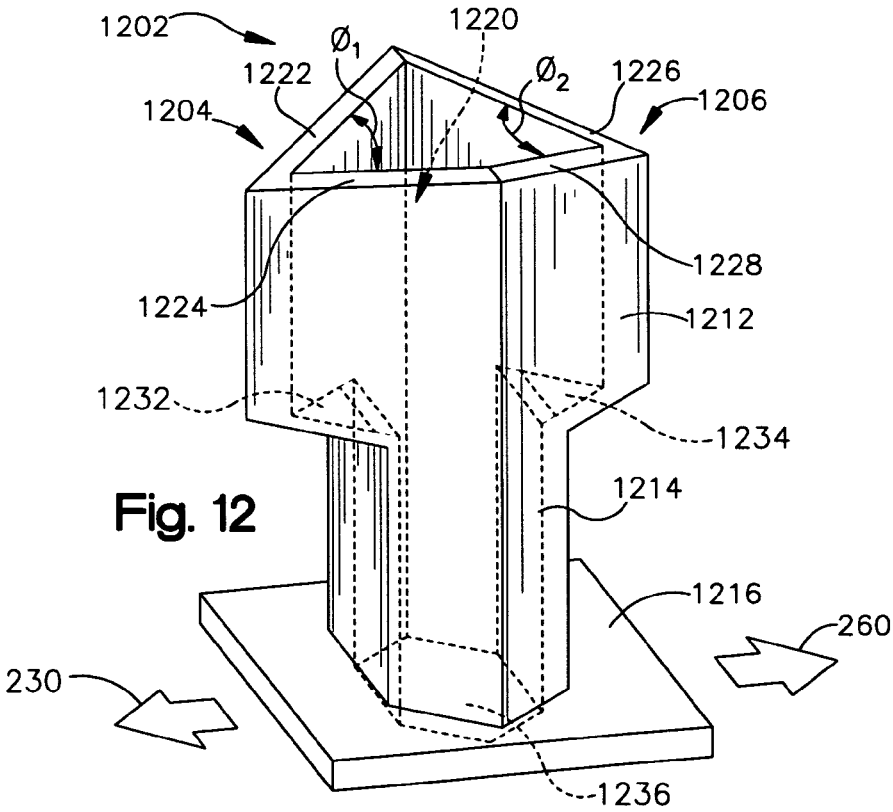
FIG. 12 is a perspective view of a wiper apparatus according to an embodiment of the invention.

FIG. 12 is a perspective view of a wiper apparatus 1202 that can be used in inkjet printer 100 (FIG. 1) according to another embodiment of the present invention. Wiper apparatus 1202 has a wiper head 1212 and stem 1214 mounted on wiper base 1216 can be moved in directions 230 and 260 for bidirectional wiping. The wiper head 1212 has a first pair of tips 1204 and a second pair of tips 1206 which lie in two distinct planes. The first pair of tips 1204 includes first tip 1222 and second tip 1224 which are oriented at a first angle $\phi_1$ with respect to each other, and the second pair of tips 1206 includes third tip 1226 and fourth tip 1228 which are oriented at a second angle $\phi_2$ with respect to each another. The angled orientation, for example, the "v-shaped" orientation of the first tip and the second tip direct ink residue and debris from the first and second array of nozzles 220, 222, in divergent directions during wiping in direction 230, to reduce the incidence of ink mixing. The angled orientation, for example, the "v-shaped" orientation of the third tip and the fourth tip direct ink residue and debris from the first and second array of nozzles 220, 222, in divergent directions during wiping in direction 260, to reduce the incidence of ink mixing. The cross-section of the wiper head through all four tips, is a tetragon. In the wiper head 1212 of FIG. 12, the first pair of tips contact the second pair of tips since the angle $\phi_1$ between the first tip and the second tip is equal to the angle $\phi_2$ between the third tip and the fourth tip. However, it is not necessary the angle which separates the first and second tips be equal to the angle which separates the third and fourth tips.

The wiper apparatus 1202 can include a cavity 1220 between the first pair of tips 1204 and the second pair of tips 1206, however, the presence of a cavity 1220 is not necessary. The cavity 1220 can serve as a reservoir to collect ink and debris that is wiped from the printhead 116, and cavity 1220 can also connect with an opening 1236 in the wiper base 1216 for drainage of the ink and debris below or beyond the wiper apparatus 1202. In another embodiment, wiper head 1212 can include openings 1232 and 1234 to allow the ink and debris that collects in cavity 1220 to exit the wiper head 1212.

Figure 13:
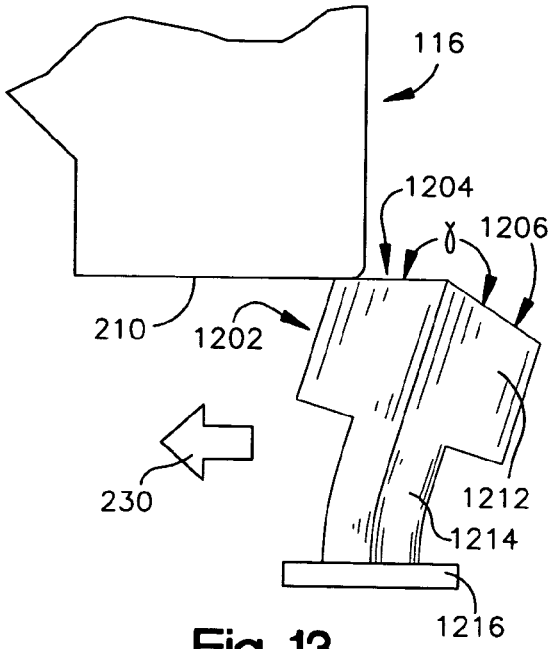
FIG. 13 is a side elevation view of the wiper apparatus of FIG. 12 wiping a printhead along a first direction of wipe according to an embodiment of the invention.

In FIG. 13, is a side elevation view of wiper apparatus 1202 as it moves in direction 230, away from the home position (FIG. 1) and comes into contact with the printhead 116. The dimensional interference between wiper apparatus 1202 and the printhead 116 causes the wiper stem 1214 to bend into the printhead 116 such that the first pair of tips 1204 mates with nozzle plate 210 for wiping. The first pair of tips 1204 and the second pair of tips 1206 of wiper head 1212 are separated by an angle δ. Therefore, when the first pair of tips 1204 is in contact with nozzle plate 210, the second pair of tips 1206 is angled away and below the plane of printhead 210. The angle δ between the first pair of tips 1204 and the second pair of tips 1206 is greater than about 180 degrees.

Stem 1214 can be designed to improve the ease and reliability of which the wiper head 1212 contacts the printhead 116. For example, stem 1214 has a smaller cross-section than the wiper head 1212 for improved flexibility. The size and geometry of stem 1214, and the material which makes up the stem 1214, as well as other factors, can have bearing on the ability of the wiper head 1212 to make contact with the nozzle plate 210.

Figure 14:
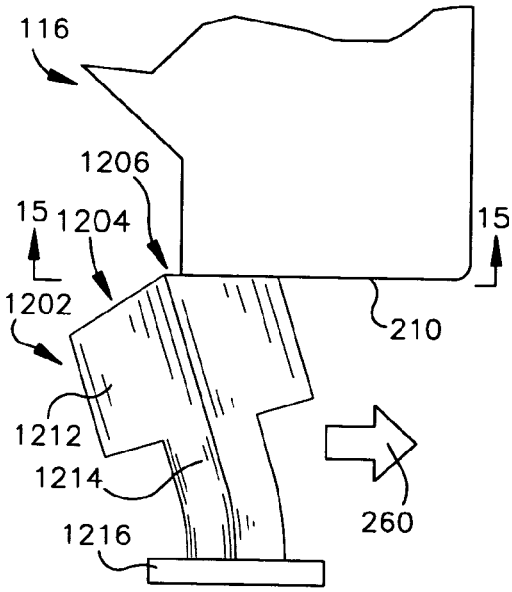
FIG. 14 is a side elevation view of the wiper apparatus of FIG. 12 wiping a printhead along a second direction of wipe according to an embodiment of the invention.

Once the wiper apparatus 1202 clears the printhead 116, the wiper apparatus can be moved in a second direction 260, opposite direction 230 as illustrated in the side elevation view of FIG. 14. As the wiper head 1212 comes into contact with the printhead 116 while moving in second direction 260, the stem 1214 bends so that the second pair of wiper tips 1206 mates with the nozzle plate 210 while the first pair of wiper tips 1204 is angled away from the printhead 116 and is not engaged in wiping.

Figure 15:
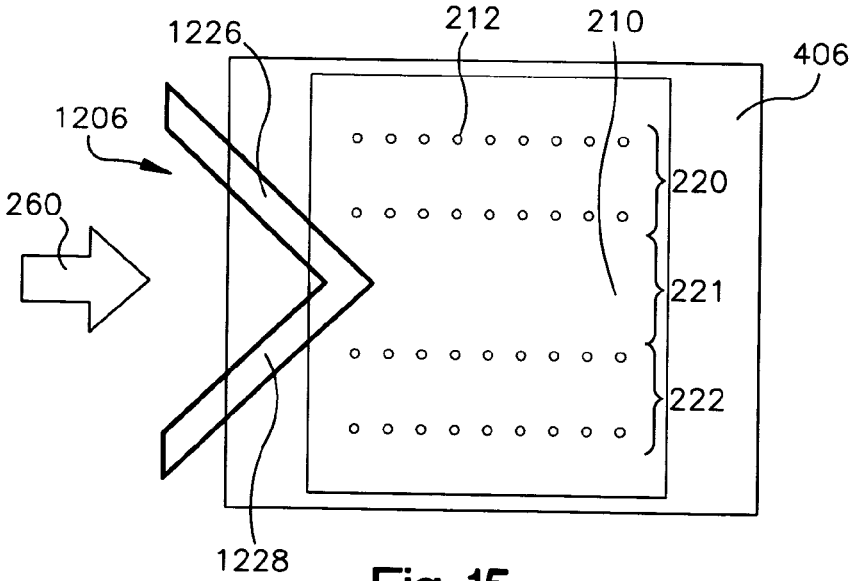
FIG. 15 is a cross-sectional view of the wiper apparatus in contact with the printhead taken along the lines 15—15 of FIG. 14 according to an embodiment of the invention.

FIG. 15 is a cross-sectional view taken along lines 15—15 of FIG. 14. The cross-section of the wiper apparatus along a plane near the surface of the nozzle plate 210 of printhead 116 shows the first tip 1226 and the second tip 1228 of the wiper apparatus 1202 engage the printhead 116 a "v-shaped" orientation.

In any of the above embodiments of the present invention, the wipers can be made of a resilient material which can include but is not limited to, elastomer, plastic, rubber, for example, EPDM rubber, silicone rubber, or any comparable material know in the art. In alternative embodiments, the stem 1214 can be substantially rigid and swiveled, at the base 1216, for example, in at least two directions as the wiper apparatus 1202 moves in the first direction of wipe 230 and the second direction of wipe 260.

It should be understood that the foregoing description is only illustrative of the invention. Various alternative and modifications can be devised by those skilled in the art without departing from the invention. Accordingly, the present invention is intended to embrace all such alternatives, modifications and variances which fall within the scope of the appended claims.

What is claimed is:

1. A wiper apparatus comprising:

a wiper having a leading contact surface and a trailing contact surface, the leading contact surface leads the trailing contact surface in a direction of wipe during wiping;

a capillary passageway in the wiper sized to allow capillary flow of a liquid along the capillary passageway by capillary forces;

a second wiper oriented substantially parallel to the wiper, the second wiper having a second leading contact surface and a second trailing contact surface; and a second capillary passageway in the second wiper sized to allow capillary flow of a liguid along the second capillary passageway by capillary forces, wherein:

the wiper and second wiper are positioned relative to a nozzle plate of a printhead such that, during wiping, a first tip of the wiper and a third tip of the second wiper come into contact with a first nozzle array of the printhead, a second tip of the wiper and a fourth tip of the second wiper come into contact with a second nozzle array of the printhead, and the capillary passageway of the wiper and the second capillary passageway of the second wiper pass between the first nozzle array and the second nozzle array during wiping.

2. The wiper apparatus of claim 1 wherein the capillary passageway has a length and a width, the length extending at least partially between the leading contact surface and the trailing contact surface and is greater than the width.

3. The wiper apparatus of claim 2 wherein the length of the capillary passageway is at least four times greater than the width of the capillary passageway.

4. The wiper apparatus of claim 1 wherein the capillary passageway has a width that is about 0.5 millimeters or less.

5. The wiper apparatus of claim 1 wherein the capillary passageway intersects at least one of the leading contact surface and the trailing contact surface.

6. The wiper apparatus of claim 1 wherein the capillary passageway intersects the leading contact surface and the trailing contact surface.

7. The wiper apparatus of claim 1 wherein the capillary passageway has a constant width.

8. The wiper apparatus of claim 1 wherein the length of the capillary passageway is oriented along an axis that is substantially perpendicular to the direction of wipe.

9. A printer device comprising:

a printhead having an nozzle plate;

a wiper apparatus comprising:

a wiper oriented to wipe the nozzle plate of the printhead, the wiper having a leading contact surface and a trailing contact surface, the leading contact surface leads the trailing contact surface in a direction of wipe during wiping;

a capillary passageway formed in the wiper, sized to allow capillary flow of a liquid along the capillary passageway by capillary forces;

a second wiper oriented substantially parallel to the wiper, the second wiper having a second leading contact surface and a second trailing contact surface; and the second wiper having a second capillary passageway formed in the second wiper and having a second length that extends at least partially between the second leading contact surface and the second trailing contact surface, and a second width that is less than the second length, wherein:

the printhead contains a first ink and a second ink, the second ink having a different composition than the first ink;

the nozzle plate has a first nozzle array to dispense the first ink and a second nozzle array to dispense the second ink; and the wiper and second wiper are positioned relative to the nozzle plate of the printhead such that, during wiping, a first tip of the wiper and a third tip of the second wiper come into contact with the first nozzle array, a second tip of the wiper and a fourth tip of the second wiper come into contact with the second nozzle array, and the capillary passageway of the wiper and the second capillary passageway of the second wiper pass between the first nozzle array and the second nozzle array during wiping.

10. The printer device of claim 9 wherein the capillary passageway has a length and a width, the length extending at least partially between the leading contact surface and the trailing contact surface and is greater than the width.

11. The printer device of claim 10 wherein the length of the capillary passageway is at least four times greater than the width of the capillary passageway.

12. The printer device of claim 9 wherein the capillary passageway has a width that is about 0.5 millimeters or less.

13. The printer device of claim 9 wherein the capillary passageway intersects at least one of the leading contact surface and the trailing contact surface.

14. The printer device of claim 9 wherein the capillary passageway intersects the leading contact surface and the trailing contact surface.

15. The wiper apparatus of claim 9 wherein the capillary passageway has a constant width.

16. The printer device of claim 9 wherein the length of the capillary passageway is oriented along an axis that is substantially perpendicular to the direction of wipe.

17. A printer device comprising:

a printhead that dispenses a first ink and a second ink through a nozzle plate, the second ink having a different composition than the first ink;

a wiper for wiping the nozzle plate of the printhead;

a means for substantially preventing mixing of the first ink and the second ink on the nozzle plate during wiping by the wiper, wherein during wiping, the means for substantially preventing mixing passing between the first nozzle array and the second nozzle array during wiping;

a second wiper for wiping the nozzle plate of the printhead, the second wiper oriented substantially parallel to the wiper; and a second means for substantially preventing mixing of the first ink and the second ink on the nozzle plate during wiping by the second wiper, the second means for substantially preventing mixing passing between the first nozzle array and the second nozzle array during wiping, wherein:

a portion of the wiper and a portion of the second wiper come into contact with a first nozzle array of the printhead and a second portion of the wiper and a second portion of the second wiper come into contact with a second nozzle array of the printhead.

18. The printer device of claim 17 wherein the means for substantially preventing mixing of the first ink and the second ink on the nozzle plate draws the first ink and the second ink away from the nozzle plate.

19. The printer device of claim 18 wherein the means for substantially preventing mixing of the first ink and the second ink on the nozzle plate is a capillary passageway on the wiper.

20. The printer device of claim 17 wherein:

the nozzle plate has a first nozzle array to dispense the first ink and a second nozzle array to dispense the second ink;

the means for substantially preventing mixing of the first ink and the second ink on the nozzle plate during wiping causes capillary flow of the first ink and the second ink between the first nozzle array and the second nozzle array.

21. A method for cleaning a printhead comprising:

placing a wiper in contact with the printhead having a nozzle plate that dispenses a first ink and a second ink, the second ink having a different composition than the first ink;

moving the wiper relative to the nozzle plate in a first direction of wipe, wherein a first tip of the wiper is moved across a first nozzle array of the nozzle plate and a second tip of the wiper is moved across a second nozzle array of the nozzle plate;

drawing, by capillary action, the first ink and the second ink into a capillary passageway of the wiper;

moving the capillary passageway along the nozzle plate between the first nozzle array and the second nozzle array;

placing a second wiper in contact with the printhead having the nozzle plate that dispenses the first ink and the second ink, the second wiper oriented substantially parallel to the wiper;

moving the second wiper relative to the nozzle plate in the first direction of wipe, wherein a third tip of the second wiper is moved across a first nozzle array of the nozzle plate and a fourth tip of the second wiper is moved across a second nozzle array of the nozzle plate;

drawing, by capillary action, the first ink and the second ink into a second capillary passageway of the second wiper; and moving the second capillary passageway along the nozzle plate between the first nozzle array and the second nozzle array.

22. The method of claim 21 further comprising:

moving the wiper relative to the nozzle plate in a second direction of wipe, that is opposite the first direction of wipe.

* * * * *

UNITED STATES PATENT AND TRADEMARK OFFICE

CERTIFICATE OF CORRECTION

PATENT NO. : 7,210,761 B2
APPLICATION NO. : 10/668760
DATED : May 1, 2007
INVENTOR(S) : James A. Mott et al.

It is certified that error appears in the above-identified patent and that said Letters Patent is hereby corrected as shown below:

In column 9, line 25, delete "distance $b_4$" and insert -- distance $b_1$ --, therefor.

In column 14, line 14, in Claim 1, delete "liguid" and insert -- liquid --, therefor.

Signed and Sealed this

Ninth Day of September, 2008

JON W. DUDAS
*Director of the United States Patent and Trademark Office*